United States Patent [19]

Gallagher

[11] 4,347,798

[45] Sep. 7, 1982

[54] BUFFER SYSTEM FOR TANKVESSELS

[76] Inventor: John J. Gallagher, 4206-13th St. NE., Washington, D.C. 20017

[21] Appl. No.: 207,661

[22] Filed: Nov. 17, 1980

Related U.S. Application Data

[63] Continuation-in-part of Ser. No. 911,528, Jun. 1, 1978, abandoned.

[51] Int. Cl.[3] ..... B63B 25/08

[52] U.S. Cl. ..... 114/74 R; 114/74 T; 220/85 B

[58] Field of Search ..... 220/85 B, 900; 114/74 R, 74 A, 74 T, 256, 333, 334; 222/386.5

[56] References Cited

U.S. PATENT DOCUMENTS

| | | | |
|---|---|---|---|
| 2,346,505 | 4/1944 | Pruess | 114/74 R |
| 2,696,185 | 12/1954 | Snoddy | 114/74 R |
| 3,251,328 | 5/1966 | Rigsby | 114/333 |
| 3,477,401 | 11/1969 | Hayama | 114/74 A |
| 3,747,800 | 7/1973 | Viland | 220/85 B |
| 3,785,321 | 1/1974 | Backstrom | 114/74 R |
| 3,811,460 | 5/1974 | Capdevielle | 220/85 B |
| 3,844,239 | 10/1974 | McLaughlin | 114/74 R |
| 3,883,046 | 5/1975 | Thompson | 220/85 B |
| 3,906,880 | 9/1975 | Hebert | 114/74 R |
| 3,922,985 | 12/1975 | Hamilton | 114/74 R |
| 3,943,873 | 3/1976 | Hering | 114/74 R |

*Primary Examiner*—Trygve M. Blix
*Assistant Examiner*—D. W. Keen

[57] ABSTRACT

A buffer system for liquid cargo-carrying tankvessels including closed, flexible buffer tanks in way of at least the bottoms of the cargo tanks and apparatus to transmit a buffer fluid to and from the buffer tanks to selectively provide buffer protection for the cargo against penetration of at least the tank bottoms. The buffer tanks are also used for carrying clean ballast and for carrying cargo which is incompatible with the cargo carried in the cargo tanks.

5 Claims, 4 Drawing Figures

BUFFER SYSTEM FOR TANKVESSELS

This is a continuation-in-part of application Ser. No. 05 911,528 filed June 1, 1978 which has been abandoned in favor of this application.

BACKGROUND OF THE INVENTION

Operators of bulk liquid cargo ships and barges (tankvessels), have come under increasing pressure to avoid polluting spills when casualties such as collisions and groundings occur. The cargo tanks of tankvessels are formed by intersecting longitudinal and transverse bulkheads which divide the hull of the vessel into independent tanks. The hull forms the bottom of the tanks and, on the side tanks (known as wing tanks), one side of the tank. There is a movement, particularly in the United States, to require all tankvessels to at least have plating inside of and spaced from the bottom of the hull to form void spaces beneath the cargo tanks in the vessel (double bottoms). Such requirements have been resisted for a variety of reasons, not the least of which includes the reasoning that double bottoms will not actually protect the cargo since most penetrations of the hull are of such a nature that the double bottom will be at least fractured by the hull penetration. Another disadvantage of double bottoms is that the void spaces formed thereby create collection points for vapors thereby generating an explosion hazard. Other obvious disadvantages of double bottoms are that they add weight to the vessel and cost to its construction, cut down on the cargo carrying capacity of the vessel and are impossible to reasonably retrofit in existing tankers.

A fact of the geographical situation of the Middle East oil producing nations is that, although rich in oil, they are poor in potable water. Potable water is expensive to produce and various schemes, such as towing iceburgs from the Antarctic, have actually been seriously considered to remedy the situation. These nations are in need of potable water, from whatever source it can be economically provided.

SUMMARY

This invention provides a system for furnishing a double bottom like buffer for cargo in tankvessels which avoids the disadvantages of conventional double bottom protection.

The system also provides a means to segregate ballast water from the cargo spaces without requiring dedicated ballast tanks.

The invention further provides a system by which incompatible liquids such as crude oil and potable water can be carried in the same cargo space simultaneously or alternately without the need to clean tanks between cargoes.

This invention provides a system of closed, flexible buffer tanks disposed on and fixed to the bottoms of the cargo tanks to cover the entire cargo-carrying bottom of a tankvessel. Means, communicating with the buffer tanks, transmit buffer fluid thereto to form a buffer space between cargo subsequently loaded into the tank and the hull portion of the vessel which forms a wall of the tank in which the buffer tank is disposed. The buffer space tank, since it is isolated from the cargo tank, can thereby also serve to carry cargo which is incompatible with the cargo in the cargo tank.

The inventor is aware of the device in U.S. Pat. No. 3,251,328 where a flexible ballast bag is provided for a submarine. Other than the fact that the ballast bag is flexible, that invention has little relation to the present invention in that the ballast bag of that system is simply intended as an inexpensive, simple expedient to provide a ballast system for a one man submarine. It is not intended, does not function, and is not configured to protect anything. It furthermore does not serve to separate or otherwise segregate any kind of liquid cargo from the ballast water.

The applicant is also aware of several attempts to develop segregated ballast systems for vessels utilizing a flexible diaphraghm as disclosed in the U.S. Coast Guard Report *Evaluation of Membrane Oil Pollution Prevention,* System Research CG-D-175-75. These attempts have been unsuccessful due primarily to the difficulty experienced in fastening the diaphragm edges to the vessel structure to provide a durable, fluid-tight seal under conditions of continuous use and loads imposed under sea conditions. The present invention is both distinguished over and avoids the problems of those devices by providing closed buffer tanks or envelopes which are indepentent of a seal to the vessel structure to maintain their integrity.

The objects and specific advantages of this invention will become better understood to those skilled in the art by reference to the following detailed description when viewed in light of the accompanying drawings wherein:

DESCRIPTION OF A PREFERRED EMBODIMENT

Figure 1:
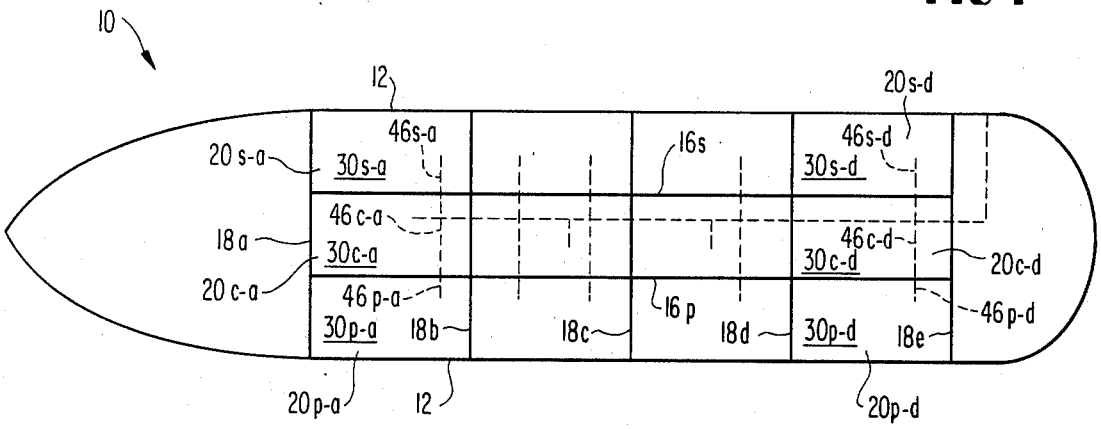
FIG. 1 is a schematic plan view of a tankvessel embodying a system in accordance with the invention.

In FIG. 1, the tankvessel, shown generally at 10, comprises hull side walls 12 and a hull bottom 14 (FIG. 2) formed in a conventional manner to make up a conventional buoyant structure. The hull is devided by starboard and port longitudinal bulkheads 16*s* and 16*p* which intersect hull-deviding transverse bulkheads 18*a* through 18*e* to form twelve independent tanks 20*s-a, c-a,* and *p-a* (starboard, center and port row a) through 20*s-d, c-d,* and *p-d* (starboard, center and port—row d) as shown. The number, layout and relative size of the tanks can vary from ship to ship. Most barges have only a single center line longitudinal bulkhead. The arrangement illustrated is merely exemplary of the layout of many tankships. Deck 22 (FIG. 2) covers the tanks to form complete enclosures.

There are many ancillary structures which form the necessary parts of every tankvessel and which have been ommitted here since they do not form part of this invention and clarity is served thereby. These structures, including structural members such as stiffeners, stringers and web frames as well as plumbing including piping, bellmouths and heating coils, are conventional and their presence and function is well understood and known to those skilled in the art. It suffices to say that structural members can be accomodated by the flexible nature of the inventive structure or the inventive structure can be tailor-fitted to accomodate such structure.

Devices such as bellmouths, piping, and heating coils can be placed out of the way of the inventive structure or be made movable so as to move out of the way as is necessary to not interfere with the invention.

Figure 2:
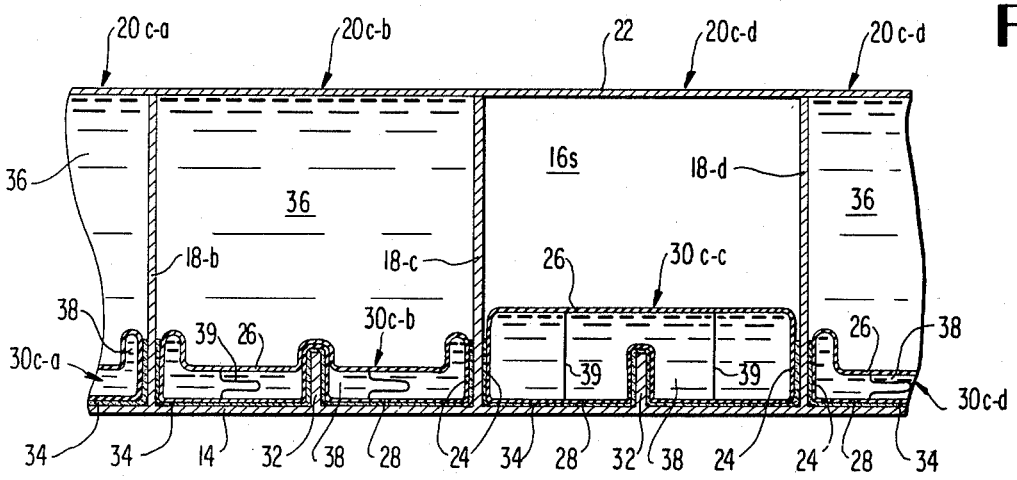
FIG. 2 is an enlarged, fragmentary side view of the vessel of FIG. 1.

In FIG. 2, the inventive system comprises flexible side, top and bottom walls 24, 26, and 28 forming buffer tanks or envelopes shown generally at 30*c-a*, 30*c-b*, 30*c-c*, and 30*c-d*, is disposed in each of the correspondingly numbered cargo tanks. The bottom walls 28 of the buffer tanks cover and conform to the bottom hull 14 portions of each of the respective cargo tanks as shown. Web frames 32 extend upwardly from the bottom of the cargo tanks as shown to illustrate the manner in which the flexible structure of the buffer tanks can be conformed to structural irregularities in the tanks. If the irregularity is deemed too great for such conformation, as in many cases it will be, two or more buffer tanks, tailor made to fit on either side of the irregularity can be utilized to avoid the problem if need be. Burrs, sharp edges, and other abrading conditions on adjacent structure should be removed or covered with chaffing gear before installation of the buffer tanks.

The bottom of the tanks 28 are fixed to the portion of the hull bottoms 14 forming the bottom of the cargo tank in which they are disposed, preferably by means of a suitable adhesive 34. The adhesive, of any type compatible with the environment in which it is used and suitable for fixing the elastomer in the buffer tanks to the hull, structural, and bulkhead materials under the stresses anticipated, seals the buffer tank bottom 28 to the hull bottom 14 and other structure to fix the bottom 28 against chaffing on the hull bottom and other structural members (such as the web frame 32), and to preclude migration of cargo between the walls. The side walls 24 of the buffer tanks 30 may also be similarly fixed, for a portion of their height, to adjacent vertical structures by means of adhesive primarily to preclude chaffing between the side walls and that structure. Te elastomer utilized for the buffer tanks 30 may be of any type suitable for the purposes of this invention from a standpoint of strength, flexibility and durability and compatible with the environment of hydrocarbons, chemicals, cleaners, sea water and other elements normally encountered at sea by tankers. Particularly suited for this is Dupont's *Material* 4853, a nylon based elastomer manufactured by E. I. Dupont de Namours, Inc.

In FIG. 2, the tanks are illustrated in enlarged side schematic with tanks 20*c-a*, 20*c-b*, and 20*c-d* carrying liquid cargo 36 while tank 20*c-c* is illustrated empty of cargo. The buffer tanks 30*c-a*, 30*c-b*, and 30*c-d* are filled with a buffer fluid 38 to a degree sufficient to space the upper walls 26 of the buffer tanks from the bottom of the hull 14 to thereby provide a buffer between the cargo 36 and the bottom hull. In the event of penetration of the hull bottom 14 (and probably the buffer tank bottom 28), the upper wall 26 remains to contain the cargo 36 and preclude discharge through the penetration. At this point, an advantage over conventional double bottoms and an answer to at least two of the criticisms of those systems provided by this invention should be discussed. In the event of high energy penetration (something more than the mere fracture or slight penetration of the hull), the flexible nature of the buffer tank top 26 provides for substantial deflection of that top without rupture so that, even if the penetration should be beyond the plane of the top wall 26 in tanks 20*c-a*, 20*c-b* and 20*c-d*, penetration of the top wall would be resisted by deflection of that wall. The flexible nature of the buffer tank also precludes failure through shock fracture of its structure, a probable mode of failure to which rigid tanks may be susceptible. The inventive system also precludes the presence of the void spaces inherent in conventional double bottoms by providing for a buffer fluid in the buffer tanks during most of the normal conditions on the ship. The portion of the buffer tank fixed to the surrounding structure provides further benefit in that it serves as chaffing gear for the portion of the buffer tank which is not fixed and may otherwise be subject to rubbing against the structure when the cargo tank is loaded.

The terms "liquid cargo" and "buffer fluid" have been used hereinabove to include the possibility that the cargo of the vessel may be any material which, when discharged into the water or mixed with it, would cause substantial pollution and/or hazard while the buffer fluid could conceivably include neutralizing agents for hazardous materials carried, or gasses such as $CO_2$ or air. In most situations, however, the invention is intended for use with the largest waterborne liquid cargo, crude oil and petroleum products. In such case the buffer fluid will generally consist of sea water.

The buffer tank 30*c-c* in empty cargo tank 20*c-c* is illustrated fully filled with buffer fluid to demonstrate the use of the buffer tank as a ballast tank thereby providing a segregated ballast capability for the vessel. Tankvessels transiting empty or with partial cargoes, generally must carry ballast water to increase their steerage and reduce windage. In tankvessels, ballast has heretofore been drawn into and carried in empty cargo tanks. This sea water or "dirty ballast" must later be discharged back into the sea. When this is done, the cargo which had remained in the tank used for ballast as "clingage" is discharged with the ballast water thereby polluting the sea. Although meathods such as the "load on top" system have amiliorated this somewhat, the situation continues to generate great pressure to require tankvessels to carry their ballast in separate or segregated tanks not usable for cargo. This segregated ballast requirement is already imposed on some new construction and it would appear that, unless some alternative is found, segregated ballast tanks will eventually be required on all tankvessels. Among the disadvantages of the conventional segregated system are the obvious reduction in cargo-carrying capacity for each vessel and the attendant waste of energy involved in sailing partially loaded cargo vessels. The buffer tanks of the present invention therefore inherently avoid the disadvantages of conventional segregated ballast by furnishing flexible segregated ballast tanks which can be substantially reduced in volume (to almost zero if the buffer protection is not required in cargo transit) thereby reducing or substantially eliminating cargo carrying capacity loss due to the segregated ballast system. As seen in FIG. 2, the buffer tank 30*c-c* is fully distended by the buffer fluid/ballast water 38. Since the tank is flexible, an essentially free surface for the buffer fluid exists, imparting free surface instability to the vessel unless precautions are taken to stabilize the fluid. This can be done with flexible baffles 39 fixed in the buffer tanks to extend from the top wall 26 to the bottom wall 28 as shown to provide the requisite stability in a manner known in the art.

As indicated above, details of piping and associated equipment have been largely ommitted for purposes of clarity. In FIG. 1, however, the buffer system piping is illustrated schematically and consists of a fore-and-aft manifold 40 which communicates with the individual buffer tanks 30*s-a,* 30*c-a,* 30*p-a* through 30*s-d,* 30*c-d,* and 30*p-d* via branch manifolds 46*s-a,* 46*c-a,* and 46*p-a* through 46*s-d,* 46*c-d,* and 46*p-d* as shown. In use, the buffer fluid, generally sea water, is pumped into the buffer tanks by a pump 44 drawing through a sea intake 42 and discharging through appropriate valves (not shown) to partially fill the buffer tanks as shown in tanks 20*c-a,* 20*c-b,* and 20*c-d*(FIG. 2). These tanks are then filled with cargo through conventional piping, valves, and pumps (not shown) to displace the remaining volume of the tanks with liquid cargo as illustrated.

Figure 3:
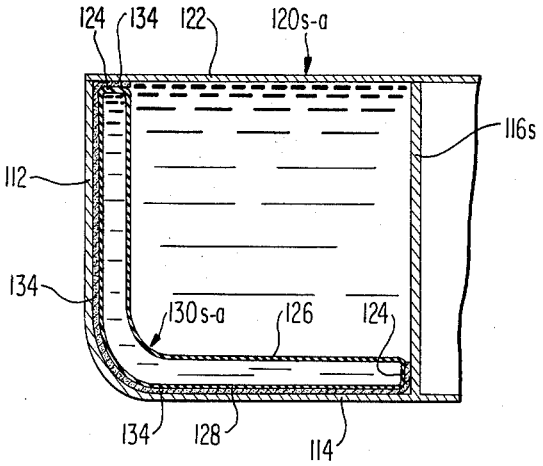
FIG. 3 is an enlarged, transverse view of the vessel of FIG. 1 showing a variation in accordance with the invention.

In FIG. 3 a variation in accordance with the invention is shown. Components thereof corresponding to like components of the preceding embodiment are indicated by like numerals of the next higher order. The variation provided by the embodiment of FIG. 3 comprises an extension of the wing cargo tank buffer tanks up the hull sidewall 112 as shown with buffer tank 130*s-a* in starboard wing tank 120*s-a.* Such a variation is furnished for the purposes of providing a buffer zone on the side of the hull as well as the bottoms to preclude loss of cargo in the event of penetration of the side wall as may be caused by a collision or other casualty involving the hull sides. In this embodiment, the top and bottom walls 126 and 128 of the buffer tank 130*s-a* extend along the hull side and bottom 112 and 114 while the side walls 124 abut the longitudinal bulkhead 116*s,* the deck 122 and the transverse bulkheads 118*a* and 118*b* (not shown) forming the forward and aft walls of the cargo tank 120*s-a.* As in the prior embodiments, adhesive 134 is used to fix the bottom and side walls 124 and 128 to the adjacent tank structures for the purposes described.

Figure 4:
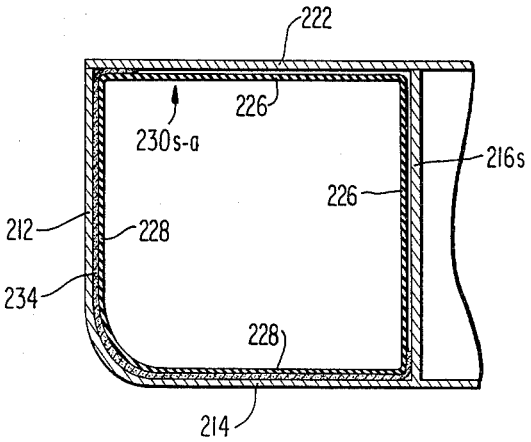
FIG. 4 is a view similar to FIG. 3 showing another variation in accordance with the invention.

Another advantageous feature which is inherent in the invention is the ability, with proper configuration of the buffer tanks, to inflate or otherwise distend the tank to substantially fill the cargo tank as is illustrated in the embodiment of FIG. 4. Again in this embodiment components therein corresponding to like components in the preceding embodiments are indicated by like numerals of still the next higher order. The benefit provided by this embodiment is that, after a volatile cargo such as low flash point crude has been discharged, the empty cargo carrying space can be substantially purged of large vapor concentrations by displacing the volume of the cargo tank with the distended buffer tank thereby reducing the quantity of potentially explosive vapor in the tank and thereby the danger of explosions from retained vapor. There is presently a trend to require crude carrying tankers to install inert gas systems (usually utilizing the vessel's stack gas) to preclude the danger of explosions from such gas mixtures. These systems are expensive and suffer some disadvantages in themselves, no the least of which involve; the waste of energy attendant with keeping boilers operating to generate stack gas when they would not otherwise be required; and the energy expended in scrubbing stack gas prior to use in the tanks. This invention would thereby, with modification, provide the added benefit of obviating the need for or reducing the volumetric requirements of inert gas systems.

Other advantages of the system would be realized if the vessel were to be stranded and a reduction in the ground force were to be required to free the vessel. In such cases the ballast fluid could be replaced in the ballast tanks by pumping in air or other gas to displace it. The buoyancy of the vessel would thereby be increased to provide or contribute to the required reduction in ground force.

Where it is desirable to carry a cargo, such as potable water to the Middle East, in one direction and an incompatible cargo, such as crude oil, in the other, the system provided by this invention can be utilized with little modification, to carry the incompatible cargoes in the cargo and buffer tanks respectively either simultaneously (two incompatible of different cargoes in one direction) or sequentially (as above).

In the latter case, the cargoes can be carried without the need for tank cleaning between cargoes. For example, crude tankers could presently carry potable water from oil-consuming countries on return ballast trips to water poor, oil producing countries in the Middle East, however, the tank cleaning needed to put the cargo tanks into condition to carry potable water without polluting it each trip would be so expensive as to render such effort economically unfeasible. With the structure of the present invention, modified perhaps to include such structure as stainless steel or other non-contaminating material in the plumbing, cargoes such as potable water, liquid or slurried foodstuffs or grains, gasses or other materials which would be rendered unsuitable if contacted by crude oil, can be transported in the buffer tanks without the need for tank cleaning between trips. In the crude oil trade, for example, such return cargo could be used as ballast to offset the crude oil lifted at no additional cost to the shipper or purchaser.

The above descriptions are primarily intended to aid those skilled in the art to practice the invention. It should therefore be understood that within the scope of the appended claims, the invention may be practiced other than specifically described. What is new and desired to be protected by Letters Patent of the United States is.

I claim:

1. In a bulk liquid cargo vessel having plural cargo tanks each having top, side and bottom walls, the system for shielding the liquid cargo carried in said tanks in the event of cargo tank penetration comprising:

top, side and bottom elastomeric walls defining at least one closed buffer tank disposed in each of said cargo tanks to correspond to like walls of said cargo tanks respectively, at least the bottom walls of said buffer tanks being formed and disposed to substantially cover the bottom walls of said cargo tanks;

means sealably fixing at least the bottom walls of said buffer tanks to the bottom walls of said cargo tanks; and fluid means communicative with each of said buffer tanks to transmit a non-pollutant buffer fluid thereto to selectively displace the top wall thereof to a first position spaced from the bottom wall of the cargo tank in which it is disposed to interpose said non-pollutant buffer fluid at least between said cargo, and the bottom wall of said cargo tanks and shield cargo loaded in said tank at least from penetration of the bottom wall thereof.

2. A system in accordance with claim 1 wherein said fluid means further transmits ballast fluid to each of said buffer tanks to selectively provide segregated ballast therein when the cargo loaded in the tank in which it is disposed has been at least partially withdrawn.

3. A system in accordance with claim 2 further comprising flexible baffles disposed in each of said buffer tanks to reduce free surface effect when ballast is disposed therein.

4. A system in accordance with claim 1 wherein said fluid means further transmits purge fluid to said buffer tanks after discharge of the cargo from said cargo tanks to selectively displace the top wall thereof to a second position spaced from the bottom walls of said cargo tanks to purge at least a portion of the gasses remaining in said cargo tanks after discharge of the cargo.

5. A system in accordance with claim 1 wherein said buffer fluid comprises potable water and said fluid means is made of a non-contaminating material to maintain the potability of said water throughout sea voyages and transfer through said fluid means.

* * * * *